US009439522B2

(12) United States Patent
Slabaugh

(10) Patent No.: US 9,439,522 B2
(45) Date of Patent: Sep. 13, 2016

(54) BANDS WITH BUCKLES AND METHODS AND APPARATUS FOR DISPLAYING BAND AND BUCKLE COMPONENTS

(71) Applicant: Warren Slabaugh, Rockford, IL (US)

(72) Inventor: Warren Slabaugh, Rockford, IL (US)

(73) Assignee: Heartwood Creations, Inc., Rockford, IL (US)

( * ) Notice: Subject to any disclaimer, the term of this patent is extended or adjusted under 35 U.S.C. 154(b) by 0 days.

(21) Appl. No.: 14/611,805

(22) Filed: Feb. 2, 2015

(65) Prior Publication Data

US 2016/0220043 A1 Aug. 4, 2016

(51) Int. Cl.

| | |
|---|---|
| ***A47F 7/02*** | (2006.01) |
| ***A47F 13/00*** | (2006.01) |
| ***A47F 5/00*** | (2006.01) |
| ***A44C 5/20*** | (2006.01) |

(52) U.S. Cl.

CPC ..... *A47F 7/022* (2013.01); *A44C 5/20* (2013.01); *A47F 5/0006* (2013.01); *A47F 7/02* (2013.01); *A47F 13/00* (2013.01)

(58) Field of Classification Search

CPC ..... A44B 5/02; A44B 11/00; A44B 11/005; A44B 11/25; A44B 11/26; A44B 11/266; A44B 17/0023; A44B 17/0047; A44C 5/2057; A44C 5/2061; A44C 5/2066; A44C 5/2076; A47F 3/00; A47F 2/10; A47F 7/02; A47F 7/022

USPC ..... 186/52, 57

See application file for complete search history.

(56) References Cited

U.S. PATENT DOCUMENTS

| | | | | |
|---|---|---|---|---|
| 4,962,965 | A * | 10/1990 | Glover | A47D 15/006 24/579.11 |
| 6,264,046 | B1 * | 7/2001 | Ford | A47F 5/0823 206/459.5 |
| 2008/0028791 | A1 * | 2/2008 | Nardin | A44C 5/0053 63/3.1 |
| 2011/0197483 | A1 * | 8/2011 | Gray | A44C 5/2085 40/633 |

* cited by examiner

*Primary Examiner* — Mark Beauchaine
(74) *Attorney, Agent, or Firm* — H. Michael Brucker

(57) ABSTRACT

In a personalized band closed by a side release buckle comprising a hook fixedly attached to each end of the band and a double-sided catch for receiving and securing the hooks. A display panel for separately displaying band straps and personalized catches.

4 Claims, 4 Drawing Sheets

FIG. 3A
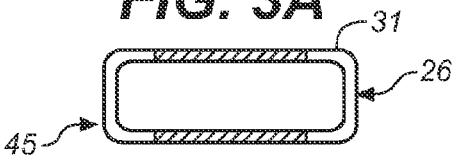
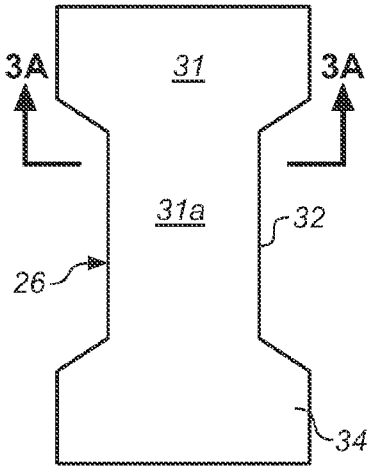
FIG. 3B
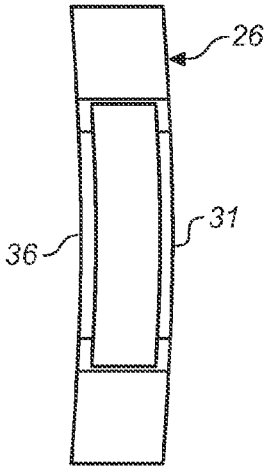
FIG. 3D
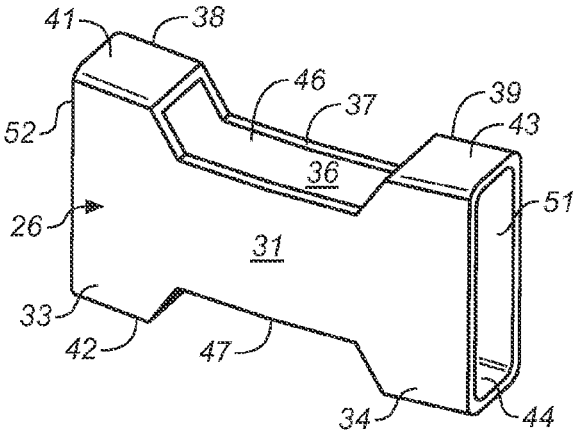
FIG. 3C
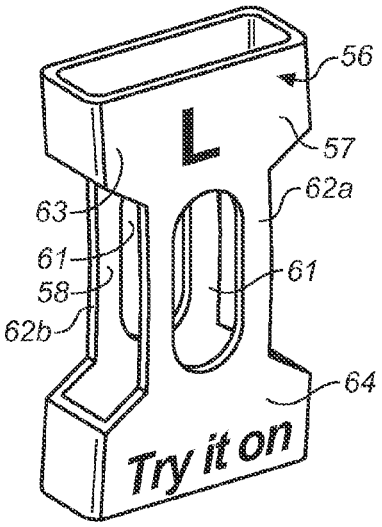
FIG. 4

BANDS WITH BUCKLES AND METHODS AND APPARATUS FOR DISPLAYING BAND AND BUCKLE COMPONENTS

CLAIM OF PRIORITY

The present divisional application claims priority to pending U.S. patent application Ser. No. 15/230,694, filed Mar. 14, 2013, by inventor Warren Slabaugh.

FIELD OF THE INVENTION

The present invention relates to bands and buckles for bands and, in particular, to personalized fashion bracelets and the like, and to apparatus for displaying fashion bracelet components, and, more particularly, to fashion bracelets that comprise a strap and an exchangeable personalized buckle.

BACKGROUND

A fashion item particularly popular among young people today is a "paracord" bracelet comprised of a strap of woven parachute cords (paracords) connected by a side release buckle, with the buckle personalized by a graphic such as a person's given name, a favorite team, a city, state, saying, or the like. Side release buckles are well known and commonly used to connect straps together, such as in connection with backpacks, luggage, and a wide variety of other items where straps are used and need to be releaseably joined. Side release buckles generally comprise a male component commonly referred to as the "hook" and a female component commonly referred to as the "catch". Throughout, it will be understood that the terms "female" and "catch" refer to the buckle component that releaseably receives the component referred to here as either the "male" or "hook".

Known paracord bracelets comprise a woven strap with a side release buckle wherein the hook component of the buckle is non-releaseably attached to one end of the strap and the catch component is non-releaseably attached to the other end of the strap. The bracelet is secured to and released from a person's wrist by connecting and disconnecting the buckle male and female components.

Such bracelets are typically offered in a variety of strap variations, such as colors or weaves, sizes, and personalized graphic on the face of the buckle catch.

In order for a brick-and-mortar retailer, for example, to offer to customers a bracelet personalized with the name "Aidan", for example, with 10 strap variations and three sizes (small, medium and large), it is necessary to have an inventory 30 bracelets. In order to accommodate multiple demands for the same combination of name, strap variation and size for the one name "Aidan", it is reasonable to inventory 5 of each for a total of 150 bracelets for that one name. To offer 50 names (or other personalized graphic) requires 7,500 bracelets. This requires a large initial inventory and concomitant cost and the need to frequently resupply the inventory.

With the present invention, for the same choices—5 each of 10 strap variations in 3 sizes (150) and 5 each of 50 different buckle names in one size (250)—a total of only 400 pieces are required.

SUMMARY OF INVENTION

The present invention provides a bracelet and the like with a buckle having a component that is readily releasable from the bracelet strap and has a space for a graphic such as a name, graphic or other personalization. In this way, the personalized buckle component is not a dedicated part of the bracelet strap, but rather is free to be attached to any strap with a hook at each end and of a variation and size selected by a customer.

With the present invention, a customer shopping for a personalized bracelet can approach a rack displaying bracelet straps and personalized buckle components, select a strap from a variety of choices and sizes, then select a personalized buckle component from a separately displayed array of such components to complete the bracelet. If desired, the customer can select a plurality of such components of different personalization for use with only one strap and/or a variety of different straps for one personalized buckle component.

DESCRIPTION OF DRAWINGS

FIG. 3A is a cross-sectional view of the double-sided catch for a side release buckle of the present invention taken along the line 3A-3A of FIG. 3B;

FIG. 3B is a top plan view of the double-sided catch for a side release buckle of the present invention;

FIG. 3C is a perspective view of the double-sided catch for a side release buckle of the present invention;

FIG. 3D is a side view of the double-sided catch for a side release buckle of the present invention;

FIG. 4 is a perspective view of the double-sided catch for a side release buckle of the present invention specially designed to act as a try-on catch that can be mounted on a display rack.

DETAILED DESCRIPTION OF THE INVENTION

Figure 1A:
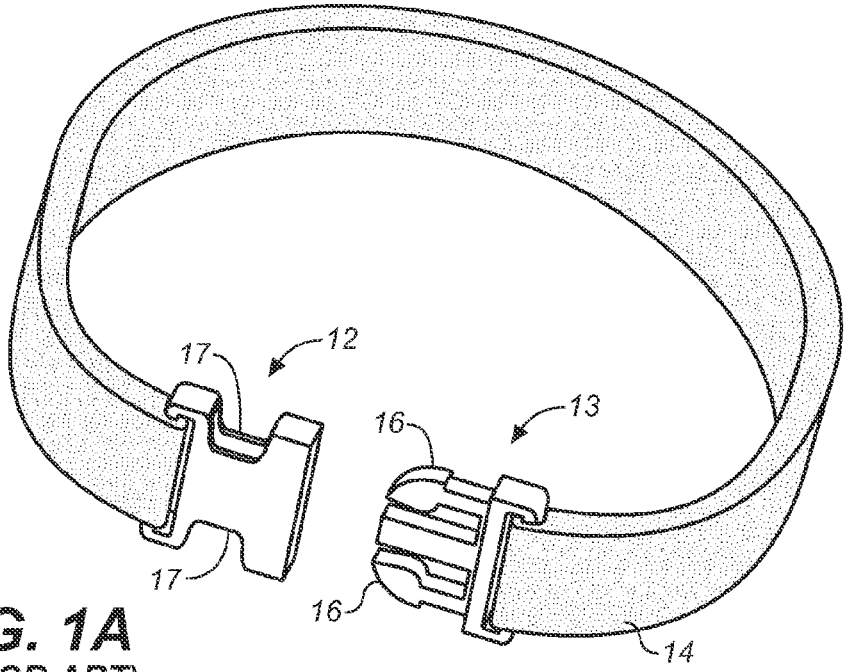
FIG. 1A (PRIOR ART)
FIG. 1A is a perspective view of a prior art band and attached buckle shown in an unbuckled condition.
Figure 1B:
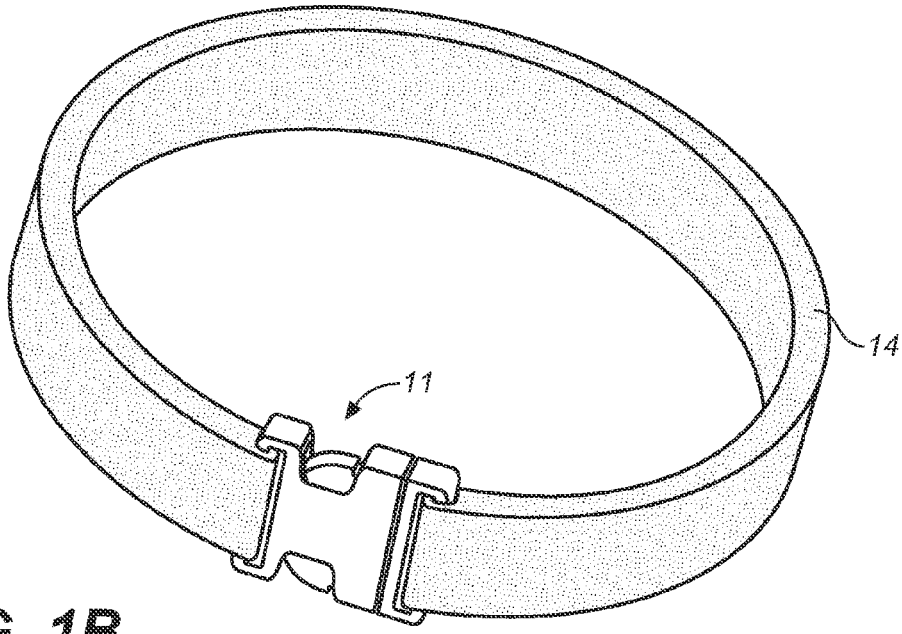
FIG. 1B (PRIOR ART)
FIG. 1B is the same as 1A with the buckle in the buckled position.

Referring to FIGS. 1A and 1B, a prior art side release buckle 11 comprises a catch (female) 12 and a hook (male) 13, each fixedly attached to a strap 14. When the hook 13 is inserted into the catch 12, the extending hook prongs 16 are compressed inwardly until they reach that portion of the catch 12 that has side openings 17 that permit the compressed prongs 16 to flex back to their uncompressed position (FIG. 1B) and become locked in the catch 12. To release the hook 13, the sides of prongs 16 are squeezed together causing the hook 13 to be released from the catch.

Figure 2A:
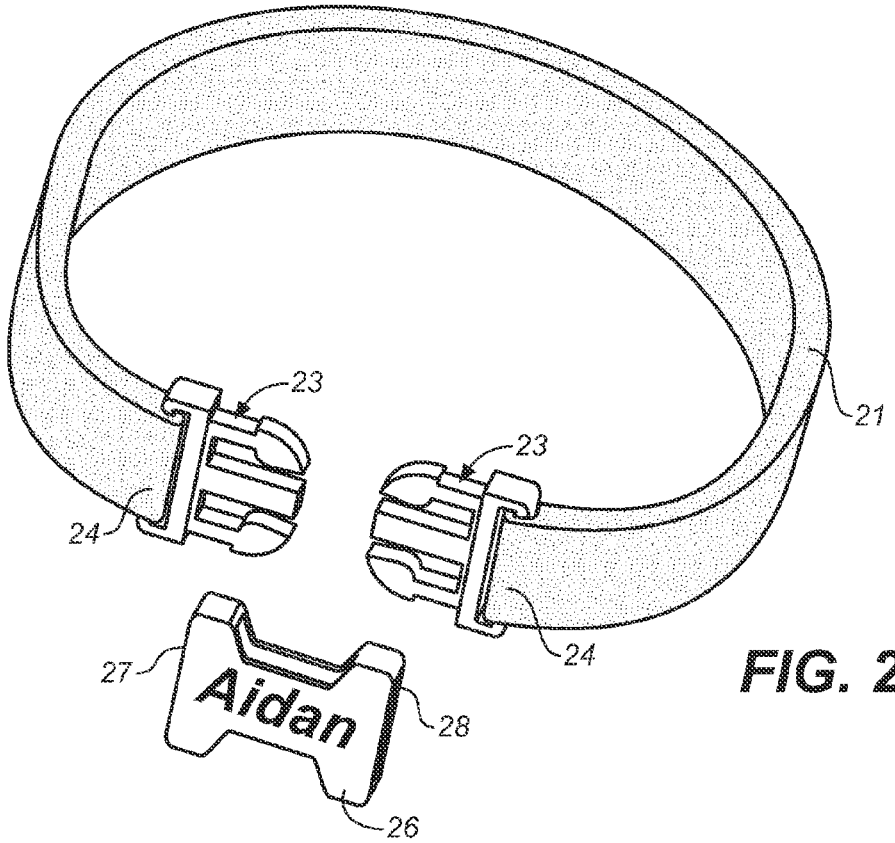
FIG. 2A is a perspective view of a band and buckle of the invention shown in an unbuckled condition.
Figure 2B:
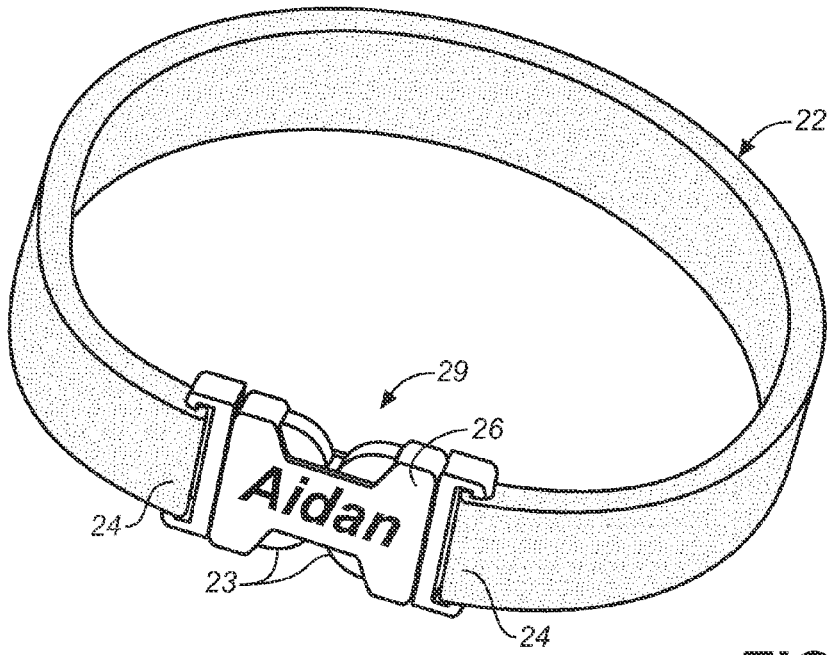
FIG. 2B is the same as 2A with the buckle shown in the buckled position.

Referring to FIGS. 2A and 2B, a strap 21 for forming a bracelet band 22 has a hook 23 fixedly attached to each of the strap ends 24. To connect the strap ends 24 and create a completed band 22, a double-sided catch 26 is provided. In order to secure the band 22 around a wrist, one hook 23 is inserted and locked in a first catch end 27 of the double-sided catch 26 and the other hook 23 is inserted and locked in a second end 28 of the double-sided catch 26. Together, the two hooks 23 and the double-sided catch 26 comprise a buckle 29.

Referring to FIGS. 2A and 3A-3D, a double-sided catch 26 of the invention comprises a generally rectangular top member 31 that is narrower at its waist 32 than at its wider ends 33 and 34 and a substantially identical bottom member 36 that is narrower at its waist 37 than at its wider ends 38 and 39. The top member 31 and bottom member 36 are joined by side members 41, 42, 43 and 44 that secure the wider ends 33 and 34 of the top member 31 to the bottom member 36 wider ends 38 and 39, respectively. Side members 41, 42, 43 and 44 maintain the top and bottom members 31 and 36 spaced apart from one another, forming a generally tubular structure 45 (FIG. 3A) with side openings 46 and 47 adjacent the waist 32 of the top member 31 and 37 of the bottom member 36. In one embodiment, the top and bottom members are formed to have a slight convex curve as best seen in FIG. 3D.

The tubular double-sided catch 26 has end openings 51 and 52 sized to operatively receive a hook 23 (FIG. 2A). The catch 26 is of sufficient length that when a hook 23 is fully inserted in each end opening 51 and 52, they do not abut, whereby the hooks 23 are able to fully lock in place. When the hooks 23 are connected in the double-sided catch 26, the buckle 29 and the two ends of a strap 21 are joined together while, at the same time, the double-sided catch 26 can be removed completely from the strap 21.

In one embodiment, the top member 31 includes a contiguous upper surface 31*a* onto which a personalizing graphic 48 ("Aidan" as shown) can be applied by any of several well known methods including, without limitation, embossing, painting, decals, and the like. In one embodiment, the upper surface 31*a* is left blank to be decorated after purchase.

The advantage of the two-sided catch 26 is that it is attachable to but, at the same time separate from, a strap 21, making it possible for a strap 21 to be personalized with a variety of different catches 26. Likewise, a single catch 26 can be attached to a variety of different straps 21.

The present invention makes it easy and convenient for a customer to determine the right size strap without having to disturb the inventory of personalized catches and, at the same time, provides a convenient way to display the straps.

Figure 5:
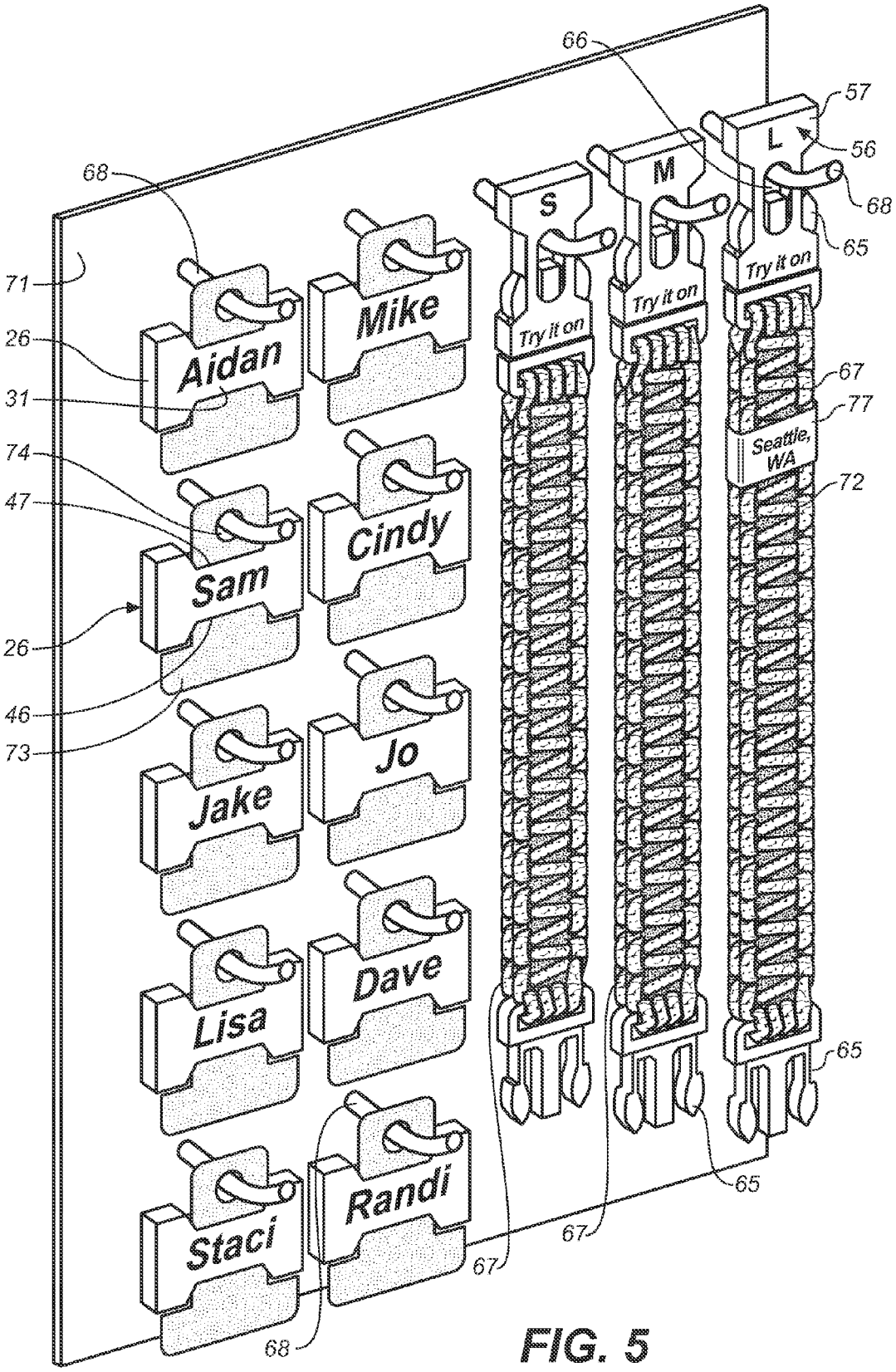
FIG. 5 is perspective view of a retail display panel and components of the invention mounted and displayed thereon.

Referring to FIG. 4, a double-sided "try-on" catch 56 is substantially the same as the double-sided catch 26 previously described, with the exception that both the top member 57 and the bottom member 58 have aligned cutouts 61 within their waists 62*a* and 62*b* between their wider ends 63 and 64. With reference also to FIG. 5, when a hook 65 is inserted into one side of the try-on catch 56, it does not extend the full length of the cutout 61, leaving an unobstructed passage 66 through the top member 57 and the bottom member 58. This passage 66 allows the try-on catch 56 and an attached strap 67 to be supported on a display hanger rod 68. In one embodiment, the try-on catch 56 has the strap size (S, M, L) (length) displayed thereon as illustrated. In one embodiment, the try-on catches 56 and personalized catches 26 are all of the same size, as are the hooks 23 whereby the personalized catches 26 can connect to any size strap 67, further reducing the number of components required for a complete initial inventory. One of the advantages that accrues to the invention is the ability to provide a multitude of choices with far fewer bracelet components than possible with prior art systems.

Referring to FIG. 5, a display panel 71 supports a plurality of hanger rods 68 for supporting and displaying merchandise. In the present invention, a plurality of bracelet straps 67 with attached side release buckle hooks 65, as described above in connection with FIG. 2A, have a side release "try-on" catch 56 attached to one of the hooks 65. The straps 67 are mounted on hanger rods 68 according to their size ("S" small; "M" medium; and "L" large) to form a size set. It will occur to those skilled in the art that multiple straps 67 of the same size would be mounted on the same hanger rod 68.

The straps 67 illustrated in FIG. 5 are "paracord" straps woven from parachute cords 72 of various colors with a hook 65 at each end woven onto the strap 67. The straps 67 can include woven paracord of various colors and/or weaves or other strap materials and colors to offer a plurality of different strap variations. In one embodiment of the invention, the display panel 71 has a plurality of size sets each of a different strap variation. Thus, by way of example, if there are 10 strap variations, all offered in three sizes, and 5 of each on a single rod, there would be as an initial inventory 150 straps 67, each with an identical (other than size indicator) attached try-on catch 56. These 150 straps would occupy 30 hanger rods 68. A customer would be able to determine his/her correct size by trying on any S, M or L strap 67 using the try-on catch 56. Once the correct size is determined, the customer can browse and select one of the different strap variations in that size.

In one embodiment, the straps 67 additionally include a wrapper 77 affixed to and surrounding the strap 67 on which a place, or event, or the like is identified, lending the strap the quality of a souvenir.

In addition to the straps 67, the display panel 71 also supports and displays a plurality of double-sided catches 26 with a variety of different names or other graphics on their top surfaces 31. In one embodiment, a card 73 with a mounting hole 74 is inserted through the side openings 46 and 47 of each catch 26 as a means for supporting and displaying the catches 26 on panel 71. Other devices for mounting catches 26 may occur to those skilled in the art and will be within the scope of the invention.

Assuming, for example, 30 different catch graphics, 10 different strap variations, and 3 different strap sizes, the total number of possible combinations is 900. The present invention makes it possible offer all 900 combinations with just 60 components (30 catches and 30 straps).

A prior art system where the catch on which the graphic is applied is permanently attached to a strap would require an initial inventory of 900 straps to offer the same choices to a customer as offered by the present invention.

The display panel 71 has been illustrated in a simplified form to disclose the essence of the invention. In a commercial embodiment, the display panel 71 could be one side of a kiosk-like stand having multiple sides, each having bracelet components mounted and displayed in various combinations. Such kiosks often are rotatable to permit ease of access. Also, while the graphics illustrated are all common given names, the invention contemplates that names of places, or teams or cities, or zip codes, or telephone area codes, or pictorial graphics, or sayings, or the like are contemplated and well within the scope of the invention. Similarly, the invention is not limited to straps of paracords as other materials that are desirable are within the scope of the invention. In addition, while bracelets are of particular interest in the market, the invention is not so limited and is equally applicable to other personalized detachable bands such as dog or cat collars, belts and the like.

Of course, various changes, modifications and alterations in the teachings of the present invention may be contemplated by those skilled in the art without departing from the intended spirit and scope thereof. As such, it is intended that the present invention only be limited by the terms of the appended claims.

What is claimed is:

1. A retail display of bracelet components, comprising;

a display panel;

a plurality of bracelet straps each having ends and a side release buckle hook affixed at each said end wherein said plurality of bracelet straps include straps of different appearances;

a plurality of double-sided bracelet catches releasably secured to said display panel separately from said bracelet straps, wherein each said catch is capable of receiving and securing together said side release buckle hooks of a said bracelet strap whereby said ends of a said bracelet strap can be releasably secured together wherein a graphic design is applied to said double-sided catches and wherein there are a plurality of different said graphic designs;

a plurality of double-sided try-on catches that are not a bracelet component wherein one said try-on catch is releasably attached to one said buckle hook of each said bracelet straps, and wherein each said try-on catch attached to a bracelet strap is releasably secured to said display panel.

2. The bracelet components retail display of claim 1 wherein said double-sided bracelet catch graphics included different given names.

3. The bracelet components retail display of claim 1 further comprising:

a wrapper surrounding said straps with location designations thereon.

4. The retail display of claim 1 wherein said display panel further comprises a plurality of hanger rods extending from said panel and wherein said try-on catches further comprise a transverse opening through which a said hanger rod can pass whereby said try-on catches and a said bracelet strap attached to a try-on catch is releasably attached to said display panel.

* * * * *